United States Patent [19]

Sato et al.

[11] 4,244,690

[45] Jan. 13, 1981

[54] METHOD OF DYEING FIBROUS PRODUCTS

[75] Inventors: Kanji Sato; Kazuyoshi Kushibe; Masaru Nishii; Yasuhiro Kanaya; Yasumasa Kawabe, all of Fuji, Japan

[73] Assignee: Tokai Denka Kogyo Kabushiki Kaisha, Tokyo, Japan

[21] Appl. No.: 12,343

[22] Filed: Feb. 15, 1979

[30] Foreign Application Priority Data

Jun. 30, 1978 [JP] Japan ..... 53-78538

[51] Int. Cl.[3] ..... D06P 1/22; D06P 1/30; C09K 3/00

[52] U.S. Cl. ..... 8/465; 8/652; 252/188

[58] Field of Search ..... 8/34, 70, 37; 252/188

[56] References Cited

U.S. PATENT DOCUMENTS

| | | | |
|---|---|---|---|
| 2,164,930 | 7/1939 | Lubs | 8/34 |
| 2,201,010 | 5/1940 | Papini | 8/34 |
| 2,576,846 | 11/1951 | Mecco | 8/34 |
| 2,882,280 | 4/1959 | Gruenebaum et al. | 8/70 |
| 3,248,337 | 4/1966 | Zirker et al. | 252/188 |
| 3,632,293 | 1/1972 | Krug | 8/34 |

FOREIGN PATENT DOCUMENTS

| | | | |
|---|---|---|---|
| 2011387 | 10/1970 | Fed. Rep. of Germany | 8/34 |
| 2350961 | 4/1975 | Fed. Rep. of Germany | 8/34 |
| 1599687 | 7/1970 | France | 8/34 |

OTHER PUBLICATIONS

Peters, R. H., *Textile Chemistry,* vol. III, Elsevier Scientific Publ. Co., N. Y., 1975, pp. 493-494.

*Primary Examiner*—Joseph L. Schofer
*Assistant Examiner*—Maria S. Tungol
*Attorney, Agent, or Firm*—Scully, Scott, Murphy & Presser

[57] ABSTRACT

According to this invention, there is provided an improved method of dyeing fibrous products characterized in that, in the dyeing of fibrous products using an oxidation-reduction dyeing type dye and an aqueous alkali solution of thiourea dioxide as a reducing solution, the reduction of the dye with the said aqueous alkali solution of thiourea dioxide is carried out in the presence of one or more substances selected from the group consisting of saturated aliphatic ketones having 3 to 10 carbon atoms, saturated aliphatic ketocarboxylic acids having 3 to 10 carbon atoms and alicyclic ketones having 3 to 10 carbon atoms.

5 Claims, No Drawings

METHOD OF DYEING FIBROUS PRODUCTS

BACKGROUND OF THE INVENTION

1. Field of the Invention

This invention relates to a dyeing method for fibrous products using an oxidation-reduction dyeing type dye and more particularly to a dyeing method in which the reduction of the oxidation-reduction dyeing type dye is carried out using a new reducing bath.

2. Description of the Prior Art

In the dyeing of fibrous products using oxidation-reduction dyeing type dyes such as vat dyes and sulfur dyes, it is sodium hydrosulfite (hereinafter referred to simply as "hydrosulfite") that has heretofore been mainly used as a reducing agent. However, hydrosulfite is poor in preservative stability and undergoes an oxidative decomposition to a large extent upon contact with air, for which reason it is an actual situation that hydrosulfite is used in large excess amount as compared with a theoretically required amount. Such decomposition of hydrosulfite is specially remarkable in a continuous pad dyeing, in which the decomposition proceeds to a remarkable extent during a short period of time from the padding of a reducing solution on the cloth until steaming. Moreover, when handling, hydrosulfite produces a bad smelling gas; therefore, also in point of public nuisance based on a bad smell there has been a demand for a reducing agent free from smell.

Recently, thiourea dioxide has attracted attention and is being studied, as a reducing agent which has a good stability in an alkali solution, less undergoes an oxidative decomposition and is free from a bad smell.

Thiourea dioxide, which is also called aminoiminomethanesulfinic acid or formamidinesulfinic acid, is sold on the market industrially and is available as a white powder superior in preservative stability and having neither oxidizing property nor reducing property, but displays reducing property when an aqueous solution thereof is made alkaline or heated. Its reducing power is very large, stability in an aqueous alkali solution is good and decomposition by an air oxidation is less remarkable, with little production of a bad smell. Thus, thiourea dioxide is an excellent reducing agent. For this reason, application of thiourea dioxide to various fiber fields including dyeing, printing, discharge printing and reduction clearing has been studied and announced in literatures, etc. In the field of dyeing, various studies for practical application have been made, but some dyes undergo reduction to an excess degree, that is, the phenomenon of a so-called "over reduction" appears, one cause of which resides in the too large reducing power of thiourea dioxide. As a result, in the next oxidation process the dye changes into a substance which no longer returns to the original structure, thus causing abnormality in the hue, dye concentration, etc. of the resulting dyed product. This phenomenon is not observed in most dyes, but blue indanthrone dyes, which are widely used, undergo such phenomenon to a remarkable extent, and using hydrosulfite as a reducing agent causes a marked difference in hue and in dye concentration from the case of using thiourea dioxide as a reducing agent. This is an obstacle to the practical application of thiourea dioxide in the field of dyeing. Methods of preventing such abnormality in hue and in dye concentration have heretofore been proposed, including the use of additives to prevent the over reduction, and a combined use with other reducing agent.

So far announced as anti-over reduction agents which are also effective in the reduction with hydrosulfite are protective colloidal substances consisting of polysaccharide such as glucose, dextrin and mannose, as well as oxidizing agents such as sodium nitrite, sodium chlorate and nitro compounds, e.g. nitropropane and nitrobenzene. However, the effect of these substances differs according to the amount and concentration of thiourea dioxide, dyes, or the above additives and also the condition used. It is a present situation that even if certain concentration and condition afford a satisfactory result, a slight change in the concentration of dye, thiourea dioxide, etc. can give an unsatisfactory result not employable in practice.

Japanese patent publication No. 47066/1977 proposes a method in which thiourea dioxide is used together with hydrosulfite in an amount of 0.05 to 100 wt.% based on the hydrosulfite used. However, since the hydrosulfite is a principal component in this proposal, the drawbacks associated with hydrosulfite are not eliminated. In addition, for dyes which easily undergo over reduction, the amount of thiourea dioxide to be used is limited. Thus, such proposed method does not give a substantial solution.

SUMMARY OF THE INVENTION

It is the object of this invention to provide an improved dyeing method not causing an abnormality in hue and in dye concentration of the resulting dyed products in the dyeing of fibrous products using an oxidation-reduction dyeing type dye and also thiourea dioxide as a reducing agent, whereby there is provided a reducing bath which eliminates the drawbacks of hydrosulfite and which is superior in stability, less undergoes an oxidative decomposition by air and scarcely produces a bad smell, and consequently it is made possible to obtain dyed products having a uniform and good finish.

DESCRIPTION OF THE INVENTION

The present invention is a dyeing method characterized in that, in the dyeing of fibrous products using an oxidation-reduction dyeing type dye and an aqueous alkali solution of thiourea dioxide as a reducing solution, the reduction of the dye with the said aqueous alkali solution of thiourea dioxide is carried out in the presence of one or more substances selected from the group consisting of saturated aliphatic ketones, saturated aliphatic ketocarboxylic acids and alicyclic ketones, all having 3 to 10 carbon atoms.

As the dyeing method using oxidation-reduction dyeing type dyes such as vat dyes and sulfur dyes there is known a method in which a dye of the said type is subjected to the action of an alkaline reducing agent to convert the dye into a water-soluble leuco compound, and the leuco compound is brought into a uniform adhesion onto a fiber and then oxidized to render it again insoluble and develop color. The various dyeing methods are adopted, depending on the temperature and time of dyeing, concentration of reducing agent and dye, liquor ratio, and so on. Various dyeing machines respectively matching dyeing methods are also available. But the method of the present invention does not restrict these dyeing conditions. Widely used methods are pad-steam dyeing, package dyeing and jigger dyeing.

The fibrous products referred to herein mean yarns, knitted and woven fabrics, and non-woven fabrics consisting alone or in combination of natural fibers such as cotton, hemp, silk and wool, semi-synthetic fibers such as viscose rayon and acetate, and synthetic fibers such as polyacrylonitrile, polyamide, polyester and polyvinyl alcohol.

It is necessary that the ketones or ketocarboxylic acids used in the present invention should be present when reducing a dye with an alkali solution of thiourea dioxide. Such ketones or ketocarboxylic acids may be added to the reducing bath, or they may be adsorbed onto a fibrous product before treatment with the reducing bath. In a continuous pad-steam dyeing, for example, in addition to the method of adding ketones or ketocarboxylic acids into a reducing bath there also may be adopted a method in which ketones or ketocarboxylic acids are used together with dyes in pigment pad process, followed by treatment with an alkaline reducing bath of thiourea dioxide and reduction by steaming. For the oxidation, neutralization, water-washing and soaping steps which follow the reduction step, conventional methods may be adopted.

The alkali in the reducing bath is not specially restricted, but usually strong alkalis, especially caustic soda, are used.

Even if other commonly used additives are employed in the dyeing with oxidation-reduction dyeing type dyes, the effect of the present invention is not affected; that is, other reducing agent, e.g. hydrosulfite, may be used as necessary together with the aqueous alkali solution of thiourea dioxide, or well-known reduction reaction promoting catalysts may be used together as necessary, or well-known additives such as a leuco solubilizer, e.g. urea, inorganic electrolyte to improve the percentage of exhaustion e.g. common salt and Glauber's salt, level dyeing agent, anti-migration agent, and penetrating dispersant, may also be used together as necessary.

It is desirable that the ketones or ketocarboxylic acids used in the present invention are soluble in water or in an aqueous alkali solution. But, for those which are difficult to dissolve in water or in such aqueous solution, a solubilizer may be used, or they may be dissolved beforehand in a water-soluble organic solvent and then added into a reducing bath. As saturated aliphatic ketones having 3 to 10 carbon atoms used in the present invention, both mono- and diketones may be used, and ketone alcohols with hydroxyl radical attached to alkyl are also included.

To exemplify such saturated aliphatic ketones, mention may be made of the following: acetone, methyl ethyl ketone, diethyl ketone, methyl isobutyl ketone, hydroxyacetone, propionylcarbinol, acetoin, diacetone alcohol, acetonylacetone, acetylacetone, diacetyl, and dipropionyl.

Saturated aliphatic ketocarboxylic acids having 3 to 10 carbon atoms include ketomono- and ketodicarboxylic acids, their salts with alkali metal, alkaline earth metal, ammonium, and alkyl ammonium of $C_1$ to $C_3$, or ketocarboxylic acid amides, and $C_1$ to $C_3$ alkyl esters of ketocarboxylic acids.

By way of illustrating such ketocarboxylic acids, mention may be made of the following: 2-ketoglutaric acid, 3-ketoglutaric acid, pyruvic acid, levulinic acid, acetoacetic acid, acetoacetic acid amide, propionylacetic acid, acetonylmalonic acid, methyl acetoacetate, ethyl acetoacetate, and acetopyruvic acid.

Alicyclic ketones having 3 to 10 carbon atoms include mono- and diketones of cyclopentane, cyclohexane and their alkylsubstituted products. Examples are cyclohexanone, cyclopentanone, cyclohexanedione, methylcyclohexanone, and dimethylcyclohexanone.

It is desirable that the amount of ketones and ketocarboxylic acids is in the range of from 0.1 to 10 times the amount of thiourea dioxide. With amounts below 0.1 times insufficient result is obtained, while with amounts above 10 times there arises an economic problem.

DESCRIPTION OF PREFERRED EMBODIMENTS

The following examples are given to further illustrate the present invention. In the examples the color of dyed products was measured by using a color-difference meter Model ND-503DE, a product of Nippon Denshoku Co., and the difference in color from standard dyed products which were dyed using hydrosulfite as a reducing agent is shown in NBS (National Bureau of Standards) unit. The preparation method for such standard dyed products was clearly shown in each example.

The relationship between NBS unit and sense is said to be as shown in Table 1 below.

TABLE 1

| Sensual Difference | Color Difference in.NBS unit |
|---|---|
| trace | 0 ~ 0.5 |
| slight | 0.5 ~ 1.5 |
| noticeable | 1.5 ~ 3.0 |
| appreciable | 3.0 ~ 6.0 |
| much | 6.0 ~ 12.0 |
| very much | above 12.0 |

In case the dyed product was a cloth, it was stuck to a white mounting board of the same whiteness, while in the case of yarn, a hank yarn was pressed against a glass plate, and the respective color differences were measured.

EXAMPLE 1

A desized, scoured and bleached 40-count single yarn cotton broadcloth was dipped in a dyeing solution at 60° C. consisting of 10 g/l Mikethren Blue BC s/f (a vat dye manufactured by Mitsui Toatsu Co.) belonging to C.I.Vat Blue 6 which is most likely to undergo over reduction, and 1 g/l sodium alginate. It was then squeezed by a mangle at 75% pick up ratio, and the cloth padded with such dyeing solution was dried in hot air at 120° C.

Then, an alkaline reducing solution consisting of 10 g/l thiourea dioxide, 40 g/l caustic soda and an additive shown in Table 2 which was added in a predetermined amount, was padded to the cloth at 85% pick up ratio. The cloth was steamed at 102° C. for 40 seconds, washed with a flowing water at 20° C., oxidized with a solution at 55° C. containing 20 g/l of 35 wt.% hydrogen peroxide and 10 g/l of 48% acetic acid, then neutralized, followed by water washing, soaping, hot water washing, water washing and drying in known manner.

As a standard dyed cloth there was used a cloth which had been treated in the same manner as above except that a solution containing 40 g/l hydrosulfite, 40 g/l caustic soda and 3 g/l glucose was used as the reducing solution. In a comparative example, no additive was added into the alkaline reducing solution of thiourea dioxide. The results are shown in Table 2 below.

TABLE 2

| Additive | Amount (g/l) | Color Difference in NBS unit |
|---|---|---|
| Comparative Example | | 18.8 |
| Hydroxyacetone | 2 | 5.1 |
| | 5 | 3.8 |
| | 10 | 2.1 |
| | 20 | 1.1 |
| | 30 | 1.8 |
| Diacetyl | 5 | 1.5 |
| Mesityl oxide | 10 | 1.4 |
| Ethyl acetoacetate | 20 | 2.1 |
| Cyclohexanone | 20 | 3.7 |
| Hydroxyacetone | 10 | |
| Cyclohexanone | 10 | 1.4 |

EXAMPLE 2

In a dyeing solution consisting of 1 g/l Mikethren Blue, BC s/f, 2 g/l thiourea dioxide, 6 g/l caustic soda and an additive shown in Table 3 which was added in a predetermined amount, there was dipped a scoured and bleached 40-count cotton two folded yarn with thorough stirring at 55° C. for 30 minutes and at a liquor ratio of 1:20. Then, the yarn was washed with water, oxidized with a solution at 55° C. containing 20 g/l of 35 wt.% hydrogen peroxide and 10 g/l of 48% acetic acid, then neutralized, followed by water washing, soaping, hot water washing and drying in known manner.

As a standard dyed yarn there was used a cotton yarn which had been dyed under the same condition as above and using a dyeing solution of the same composition except that 4 g/l of hydrosulfite was used in place of thiourea dioxide and no additive shown in Table 3 was added. In a comparative example, a dip dyeing was carried out using no additive shown in Table 3 for the dyeing bath. The results are shown in Table 3.

TABLE 3

| Additive | Amount (g/l) | Color Difference in NBS unit |
|---|---|---|
| Comparative Example | | 16.3 |
| Acetone | 0.5 | 4.0 |
| | 1 | 2.1 |
| | 2 | 1.3 |
| | 5 | 0.8 |
| | 10 | 0.7 |
| Hydroxyacetone | 5 | 0.9 |
| Acetoin | 5 | 0.9 |
| Diacetone alcohol | 5 | 0.8 |
| 2-Ketoglutaric acid | 5 | 0.9 |
| Cyclohexanone | 5 | 0.8 |

EXAMPLE 3

The same procedure as in Example 2 was repeated except that the dyeing baths shown in Table 4 were used.

As a standard dyed yarn there was used a cotton yarn which had been dyed under the same condition except that in the composition of dyeing solution shown in Table 4 4 g/l of hydrosulfite was used instead of thiourea dioxide and acetone.

TABLE 4

| No. | 1 | 2 | 3 | 4 | 5 |
|---|---|---|---|---|---|
| Dyeing Bath | | | | | |
| Nihonthrene Red FBB (g/l) (C.I. Vat Red 10) | 1 | | | | |
| Nihonthrene Olive T (g/l) (C.I. Vat Black 25) | | 1 | | | |
| Indanthrene Khaki GG (g/l) (C.I. Vat Green 8) | | | 1 | | |
| Nihonthrene Brilliant Violet RR (g/l) (C.I. Vat Violet 1) | | | | 1 | 1 |
| Thiourea dioxide (g/l) | 0.5 | 0.5 | 0.5 | 0.5 | 0.5 |
| Caustic soda (g/l) | 3 | 6 | 6 | 6 | 6 |
| Acetone (g/l) | 1 | 1 | 1 | 1 | 0.5 |
| Common salt (g/l) | 20 | | | | |
| Dyeing Temperature (°C.) | 45 | 55 | 55 | 55 | 55 |
| Dyeing Time (min.) | 40 | 30 | 30 | 30 | 30 |

The results are shown in Table 5.

TABLE 5

| No. | 1 | 2 | 3 | 4 | 5 |
|---|---|---|---|---|---|
| Color Difference in NBS unit | 0.6 | 0.5 | 0.6 | 0.4 | 0.5 |

EXAMPLE 4

The same treatment as in Example 1 was applied except that the dyeing solutions and reducing solutions shown in Table 6 were used, to obtain dyed cotton cloths.

To obtain a standard dyed cloth, the same dyeing solutions as in Table 6 were used with only change in the composition of reducing solution; that is, the composition for standard dyed cloth shown in Table 6 was used.

TABLE 6

| No. | 1 | 2 | 3 | 4 | 5 |
|---|---|---|---|---|---|
| Dyeing Solution Type of dye | Vat Dye | | | Sulfur Dye | |
| Kind of dye | Nihonthrene Red FBB | Mikethren Gold Orange 3G | Indanthrene Khaki GG | Kayaku Homodye Blue GL-S | Kayaku Homodye Olive OL-S |
| C.I. No. | Vat Red 10 | Vat Orange 15 | Vat Green 8 | — | — |
| Concentration of dye (g/l) | 20 | 30 | 20 | 45 | 45 |
| Sodium alginate (g/l) | 1 | 1 | 1 | 1 | 1 |
| Reducing Solution | | | | | |
| Thiourea dioxide (g/l) | 8 | 10 | 10 | 8 | 6 |
| Caustic soda (g/l) | 30 | 30 | 50 | 40 | 40 |
| Common salt (g/l) | 60 | 60 | | 30 | 30 |
| Kind of additive | Hydroxy-acetone | Hydroxy-acetone | Hydroxy-acetone | Hydroxy-acetone | Hydroxy-acetone |
| Concentration of additive (g/l) | 10 | 10 | 10 | 10 | 10 |
| Reducing Solution for | | | | | |

TABLE 6-continued

| No. | 1 | 2 | 3 | 4 | 5 |
|---|---|---|---|---|---|
| Dyeing Solution Type of dye | | Vat Dye | | Sulfur Dye | |
| Standard Dyed Cloth | | | | | |
| Hydrosulfite (g/l) | 40 | 50 | 50 | 50 | 50 |
| Caustic soda (g/l) | 30 | 30 | 50 | 40 | 40 |
| Common salt (g/l) | 60 | 60 | | 30 | 30 |

The results are shown in Table 7.

TABLE 7

| No. | 1 | 2 | 3 | 4 | 5 |
|---|---|---|---|---|---|
| Color Difference in NBS unit | 0.3 | 0.5 | 0.5 | 0.5 | 0.4 |

EXAMPLE 5

A desized, scoured and bleached polyester/cotton mix spinning broadcloth having a Tetoron/cotton blending ratio of 65/35 was dipped in a dyeing bath at 60° C. consisting of 10 g/l mixture of disperse dye and vat dye shown in Table 8 and 1 g/l sodium alginate. The cloth was squeezed with a mangle at 70% pick up ratio, then subjected to an intermediate drying with hot air at 110° C. for 60 seconds and further to a thermosol treatment with hot air at 200° C. for 60 seconds.

Then the cloth thus treated was padded at 70% pick up ratio with reducing solution consisting of 2 g/l thiourea dioxide, 15 g/l caustic soda, 30 g/l common salt and 2 g/l hydroxyacetone, and the padded cloth was steamed at 102° C. for 40 seconds, followed by water washing, oxidation, neutralization, water washing, soaping, hot water washing, water washing and drying in the same manner as in Example 1.

A standard dyed cloth was obtained by application of the same treatment as above except that a reducing solution consisting of 20 g/l hydrosulfite, 15 g/l caustic soda and 30 g/l common salt was used, however, that in the case of Dekatyl Blue D pst., 1 g/l of glucose was also added to the reducing solution for standard dyed cloth because the said dye is liable to undergo over reduction.

TABLE 8

| Kind of Dye | Color Difference in NBS unit |
|---|---|
| Dekatyl Blue D pst | 0.4 |
| Dekatyl Orange D pst | 0.3 |
| Unithron Blue 2FB liq | 0.4 |
| Unithron Yellow 2GF liq | 0.3 |

We claim:

1. An improved method of dyeing fibrous products comprising dyeing a fibrous product using an oxidation-reduction dyeing type dye and an aqueous alkali solution of thiourea dioxide as a reducing solution with the reduction of the dye with said aqueous alkali solution of thiourea dioxide being carried out in the presence of one or more substances selected from the group consisting of saturated aliphatic ketones having 3 to 10 carbon atoms, saturated aliphatic ketocarboxylic acids having 3 to 10 carbon atoms and alicyclic ketones having 3 to 10 carbon atoms.

2. Method according to claim 1, in which said reduction is carried out by either adding at least one substance selected from said ketones and said ketocarboxylic acids into a reducing bath, or by adsorbing said substance onto a fibrous product in advance.

3. Method according to claim 1, in which at least one substance selected from said ketones and said ketocarboxylic acids is used together with the dye to effect pigment pad, and thereafter reduction is carried out by steaming in an alkaline reducing bath of thiourea dioxide.

4. Method according to claim 1, in which at least one substance selected from said ketones and ketocarboxylic acids is used in an amount ranging from 0.1 to 10 times the amount of thiourea dioxide.

5. Method according to claim 1, in which said oxidation-reduction dyeing type dye is a vat dye, a sulfur dye or a mixture thereof.

* * * * *